US005998912A

United States Patent [19]

Schwab

[11] Patent Number: 5,998,912

[45] Date of Patent: Dec. 7, 1999

[54] SPARK PLUG

[76] Inventor: Joseph P. Schwab, 1000 Bernard Ave., Findlay, Ohio 45840

[21] Appl. No.: 08/921,974

[22] Filed: Sep. 2, 1997

Related U.S. Application Data

[63] Continuation-in-part of application No. 08/585,941, Jan. 16, 1996.

[51] Int. Cl.[6] ..... F02M 57/06

[52] U.S. Cl. ..... 313/118; 313/135; 313/139; 313/141

[58] Field of Search ..... 313/133, 135, 313/141, 118, 139, 142

[56] References Cited

U.S. PATENT DOCUMENTS 4,023,058 5/1977 Lara et al. ..... 313/139
4,970,426 11/1990 Bronchart ..... 313/141
5,264,754 11/1993 Hanitijjo et al. ..... 313/139
5,280,214 1/1994 Johnson ..... 313/139
5,373,214 12/1994 McCready ..... 313/142

*Primary Examiner*—Nimeshkumar D. Patel
*Assistant Examiner*—Michael J. Smith

[57] ABSTRACT

A spark plug including a ground electrode having an arcuate arm portion coupled with an annular upper end portion of the outer portion of a spark plug. The ground electrode has a concave portion secured to a distal end of the arcuate arm portion with the concave portion disposed over an open end portion of a central electrode within the spark plug. The concave portion has an aperture formed therethrough.

1 Claim, 3 Drawing Sheets

FIG 6
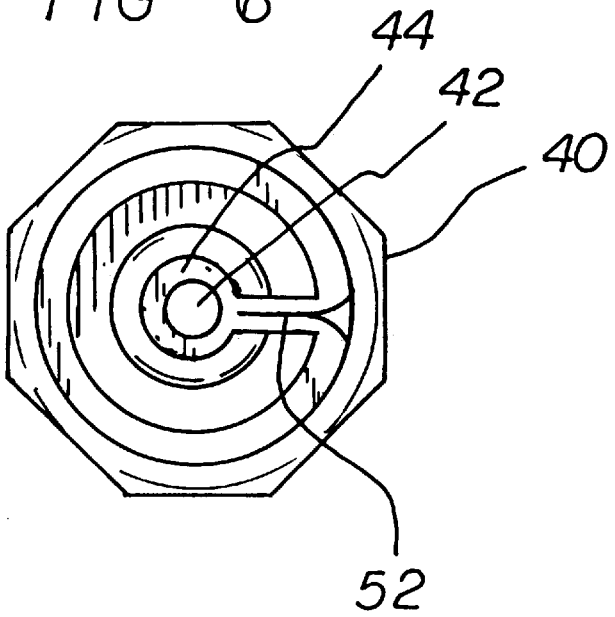
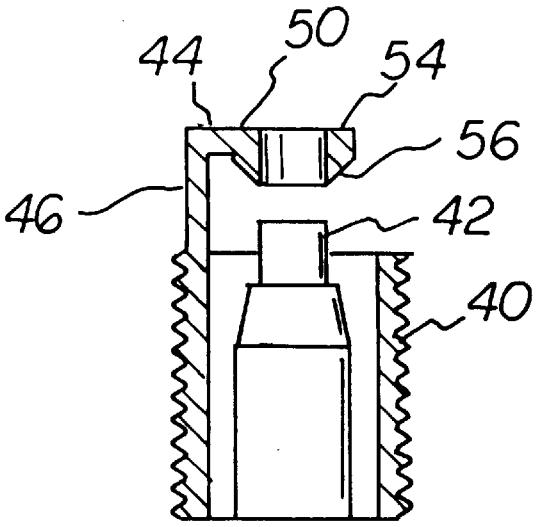
FIG 7
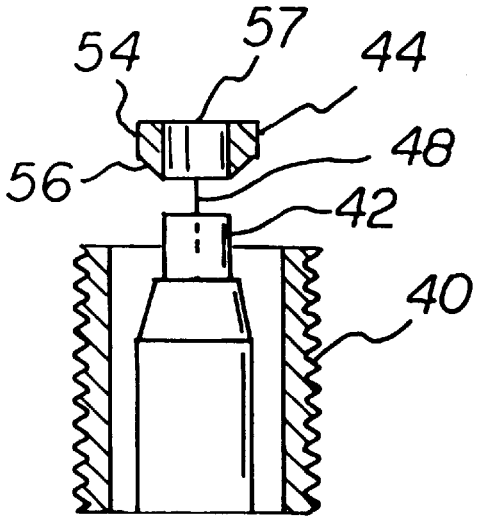
FIG 8

SPARK PLUG

RELATED APPLICATION

The present application is a continuation in part application of copending U.S. patent application Ser. No. 08/585,941 filed Jan. 16, 1996.

BACKGROUND OF THE INVENTION

1. Field of the Invention

The present invention relates to a spark plug and more particularly pertains to providing better sparks for an internal combustion engine with a spark plug.

2. Description of the Prior Art

The use of spark plugs is known in the prior art. More specifically, spark plugs heretofore devised and utilized for the purpose of igniting internal combustion engines are known to consist basically of familiar, expected and obvious structural configurations, notwithstanding the myriad of designs encompassed by the crowded prior art which have been developed for the fulfillment of countless objectives and requirements.

By way of example, U.S. Pat. No. 5,264,754 to Hanitijo et al. discloses a spark plug.

U.S. Pat. No. 3,890,518 to Tombs discloses a spark ignition plug.

U.S. Pat. No. Des. 289,998 to Lubbers discloses the ornamental design for a spark plug.

U.S. Pat. No. 5,124,612 to Takamura et al. discloses a spark plug for internal-combustion engine.

U.S. Pat. No. 3,468,004 to Bretsch discloses a spark plug.

U.S. Pat. No. 3,451,110 to Bray discloses spark plug.

While these devices fulfill their respective, particular objective and requirements, the aforementioned patents do not describe a spark plug for providing better sparks for an internal combustion engine.

In this respect, the spark plug according to the present invention substantially departs from the conventional concepts and designs of the prior art, and in doing so provides an apparatus primarily developed for the purpose of providing better sparks for an internal combustion engine.

Therefore, it can be appreciated that there exists a continuing need for new and improved spark plug which can be used for providing better sparks for an internal combustion engine. In this regard, the present invention substantially fulfills this need.

SUMMARY OF THE INVENTION

In the view of the foregoing disadvantages inherent in the known types of spark plugs now present in the prior art, the present invention provides an improved spark plug. As such, the general purpose of the present invention, which will be described subsequently in greater detail, is to provide a new and improved spark plug and method which has all the advantages of the prior art and none of the disadvantages.

To attain this, the present invention essentially comprises a spark plug having an outer portion with an annular upper end portion. The spark plug has an insulator portion secured within the outer portion. The spark plug has a central electrode secured within the insulator portion. The central electrode has an open end portion extending outwardly of the annular upper end portion of the outer portion. The device includes a ground electrode having an arcuate arm portion coupled with the annular upper end portion of the outer portion of the spark plug. The ground electrode has a concave portion secured to a distal end of the arcuate arm portion with the concave portion disposed over the open end portion of the central electrode. The concave portion has an aperture formed therethrough. The aperture has a diameter of about 7/64 of an inch.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved spark plug which has all the advantages of the prior art spark plugs and none of the disadvantages.

It is another object of the present invention to provide a new and improved spark plug which may be easily and efficiently manufactured and marketed.

It is a further object of the present invention to provide a new and improved spark plug which is of durable and reliable construction.

An even further object of the present invention is to provide a new and improved spark plug which is susceptible of a low cost of manufacture with regard to both materials and labor, and which accordingly is then susceptible of low prices of sale to the consuming public, thereby making such a spark plug economically available to the buying public.

Still yet another object of the present invention is to provide a new and improved spark plug which provides in the apparatuses and methods of the prior art some of the advantages thereof, while simultaneously overcoming some of the disadvantages normally associated therewith.

Even still another object of the present invention is to provide a new and improved spark plug for providing better sparks for an internal combustion engine.

Lastly, it is an object of the present invention to provide a new and improved spark plug including a ground electrode having an arcuate arm portion coupled with an annular upper end portion of the outer portion of a spark plug. The ground electrode has a concave portion secured to a distal end of the arcuate arm portion with the concave portion disposed over an open end portion of a central electrode within the spark plug. The concave portion has an aperture formed therethrough.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 6 a plan view of an alternate embodiment of the invention.

FIG. 7 is a side elevational view of the FIG. 6 embodiment.

FIG. 8 is a front elevational view of the FIG. 6 embodiment.

The same reference numerals refer to the same parts through the various Figures.

DESCRIPTION OF THE PREFERRED EMBODIMENT

Figure 2:
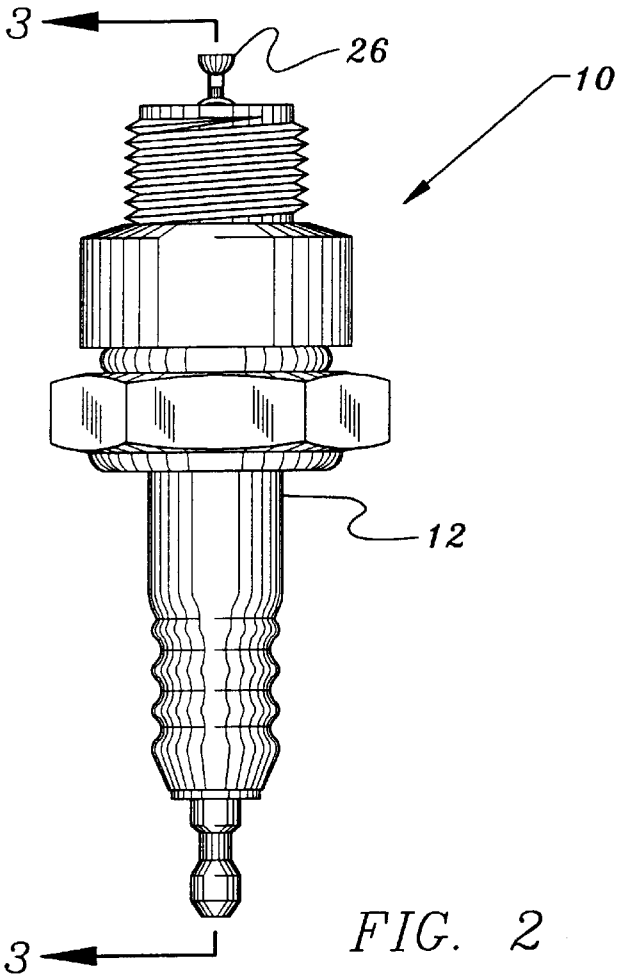
FIG. 2 is an elevated front view of the present invention.
Figure 1:
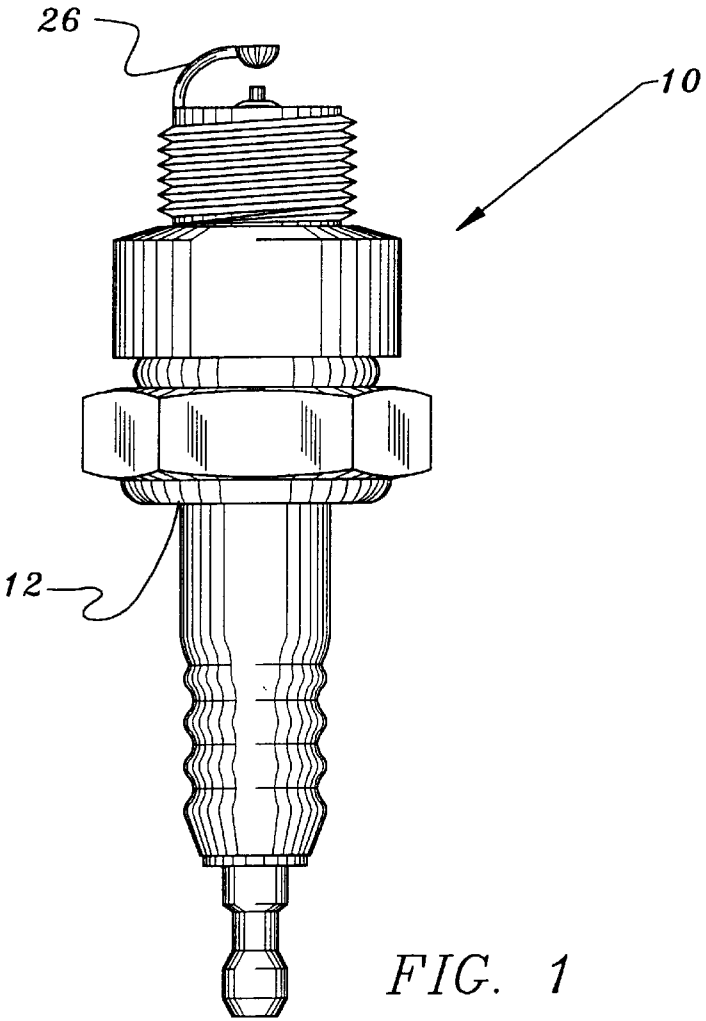
FIG. 1 is a side view of the preferred embodiment of the spark plug constructed in accordance with the principles of the present invention.
Figure 3:
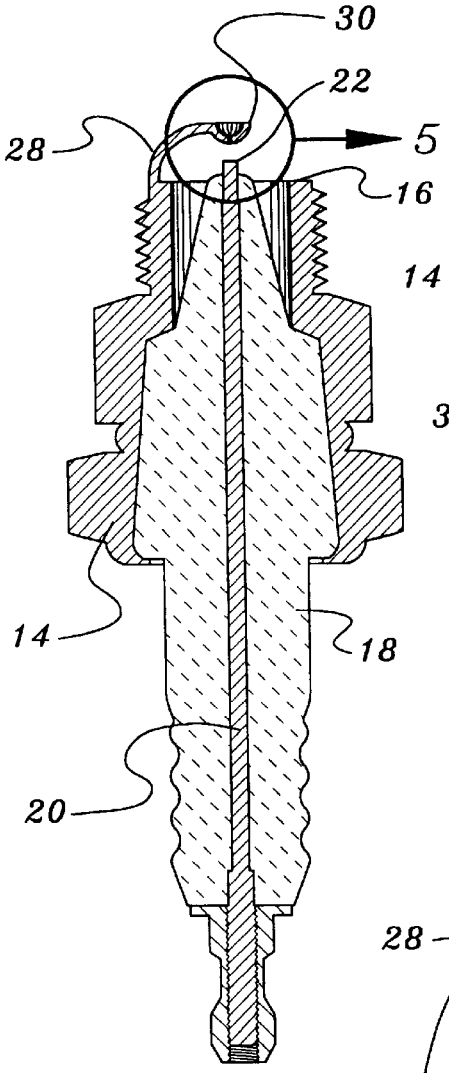
FIG. 3 is a cross-sectional view as taken along line 3—3 of FIG. 2.
Figure 4:
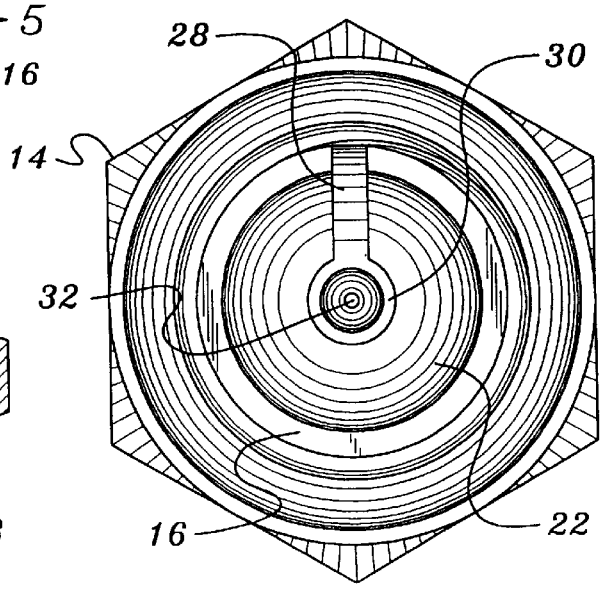
FIG. 4 is a plan view of the preferred embodiment of the present invention.
Figure 5:
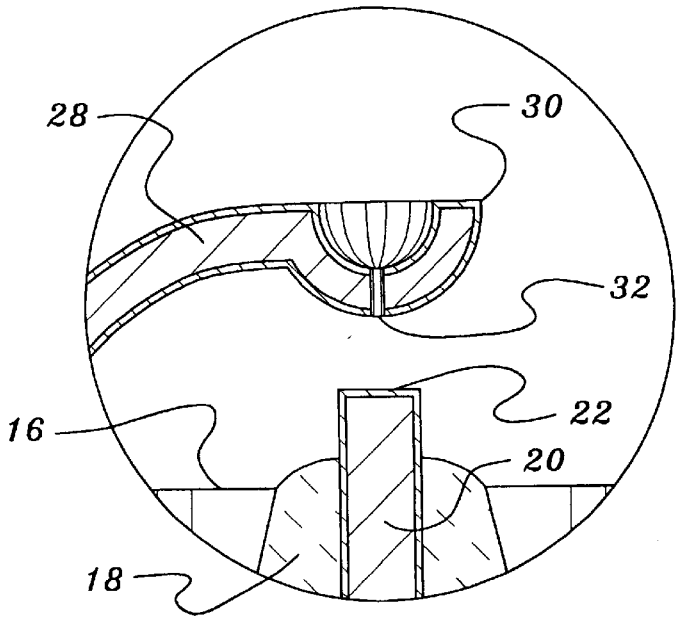
FIG. 5 is a side view of the electrode of the present invention.

With reference now to the drawings, and in particular, to FIGS. 1–5 thereof, the preferred embodiment of the new and improved spark plug embodying the principles and concepts of the present invention and generally designated by the reference number 10 will be described.

Specifically, it will be noted in the various Figures that the device relates to a new and improved spark plug for providing better sparks for an internal combustion engine. In its broadest context, the device consists of a spark plug and a ground electrode. Such components are individually configured and correlated with respect to each other so as to attain the desired objective.

The device 10 includes a spark plug 12 having an outer portion 14 with an annular upper end portion 16. The spark plug 12 has an insulator portion 18 secured within the outer portion 14. The spark plug 12 has a central electrode 20 secured within the insulator portion 18. The central electrode 20 has an open end portion 22 extending outwardly of the annular upper end portion 16 of the outer portion 14. The spark plug 12 is coupled with an engine of an automobile in the fashion known in the art.

The device 10 also includes a ground electrode 26 having an arcuate arm portion 28 coupled with the annular upper end portion 16 of the outer portion 14 of the spark plug 12. The ground electrode 26 has a concave portion 30 secured to a distal end of the arcuate arm portion 28 with the concave portion 30 disposed over the open end portion 22 of the central electrode 20. The concave portion 30 has an aperture 32 formed therethrough. The aperture 32 has a diameter of about 7/64 of an inch. The ground electrode 26 is designed to improve performance in all gas powered engines. The ground electrode 26 and the spark plug are preferably fabricated of platinum to allow for more effective spark travel. This improvement to a spark plug will provide more effective fuel economy and horsepower for any type of motor vehicle. The spark plug 12 is installed in the same manner as spark plugs present in the art.

An alternate embodiment of the invention is illustrated in FIGS. 6 through 8 similar in most regards to the primary embodiment described above. In such alternate embodiment, the spark plug 40 has a cylindrical central electrode 42 extending upwardly therefrom. In association therewith, a ground electrode 44 is specifically constructed and secured in a specific relationship with respect to the central electrode. The ground electrode has a vertically extending section 46 with a V-shaped channel 48 on its interior surface facing toward the central electrode. The ground electrode has a horizontally extending section 50 with a V-shaped channel 52 on its lower surface facing the central electrode. The V-shaped channel of the horizontal section is formed as an extension of the V-shaped channel of the vertical section with a right angle bend therebetween. The horizontal section is formed with an enlargement 54 at its free end remote from the vertical section. The enlargement includes a flat surface coextensive with the upper surface of the horizontal section. The enlargement also includes a downwardly extending, generally cone shaped extension 56. Extending vertically through the enlargement is a cylindrical hole 57. The hole is concentric with the axis of the cone shaped extension and the central electrode.

The bottom of the enlargement is spaced from the top of the central electrode a predetermined distance as a function of the particular application. Such distance is preferably about 0.6 inches but may range from 0.5 inches to 0.7 inches. The hole through the enlargement is preferably 7/64, about 0.109 inches. The diameter of the hole is essentially the same diameter of the central electrode. The hole may be about 10 percent larger or smaller, between about 0.120 inches and about 0.098 inches. It has been found that in certain applications, that a build up of carbon on the interior of the hole effectively decreasing its diameter. In such applications, the hole may begin at 0.121 inches, 20 percent greater than the initial optimum 0.109 inch diameter. The above described dimensions were derived following extensive testing. Larger and/or smaller sizes simply do not provide the efficiencies of the present invention. Such dimensions thus were found to be critical to the present invention.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A spark plug for providing better sparks for an internal combustion engine comprising, in combination:

a spark pug having an outer portion with an annular upper end, the spark plug having an insulator portion secured within the outer portion, the spark plug having a central electrode secured within the insulator portion, the central electrode having an open end portion extending outwardly of the annular upper end of the outer portion;

a ground electrode having an arm portion with a distal end and a proximal end, the proximal end being coupled with the annular upper end of the outer portion of the spark plug, the arm portion having a vertical section and a horizontal section which are formed at a right angle with respect to one another, the ground electrode having an enlarged portion with a trapezoidal cross section secured to the distal end of the arm portion, the enlarged portion having an aperture formed therethrough which is centered over the central electrode, the aperture having a diameter of about 7/64 of an inch with the enlarged portion spaced from the central electrode by between about 0.05 inches and about 0.07 inches, with the vertical section and the horizontal section having a V-shaped surface with an apex, wherein the apex of both the vertical and horizontal sections faces the central electrode.

* * * * *